United States Patent [19]

Clauss

[11] Patent Number: 4,667,844

[45] Date of Patent: May 26, 1987

[54] PAPER CONTAINER WITH A JACKET WOUND WITH A DOUBLE WALL AND PROCESS FOR ITS PREPARATION

[75] Inventor: Gerhard Clauss, Donzdorf, Fed. Rep. of Germany

[73] Assignee: Michael Horauf Maschinenfabrik GmbH & Co. KG, Sussen, Fed. Rep. of Germany

[21] Appl. No.: 708,888

[22] Filed: Mar. 6, 1985

[30] Foreign Application Priority Data

Mar. 15, 1984 [DE] Fed. Rep. of Germany ..... 3409425

[51] Int. Cl.[4] ..... B65D 90/02

[52] U.S. Cl. ..... 220/450; 220/461; 229/4.5; 229/5.5; 229/48 R

[58] Field of Search ..... 229/4.5, 21, 3.1, 48 R, 229/48 SB, 5.5, 5.6, 5.7, 5.8; 220/450, 452, 461; 493/101

[56] References Cited

U.S. PATENT DOCUMENTS

| | | | |
|---|---|---|---|
| 732,862 | 7/1903 | Jones | 229/48 R |
| 1,281,356 | 10/1918 | Harbeck | 229/48 R |
| 2,200,200 | 5/1940 | Donnelly | 229/5.7 |
| 2,307,923 | 1/1943 | Eggerss | 229/5.7 |
| 2,540,565 | 2/1951 | Barbieri | 229/4.5 |
| 2,555,380 | 6/1951 | Stuart et al. | 229/4.5 |
| 3,093,288 | 6/1963 | Stark | 229/3.1 |
| 3,247,869 | 4/1966 | Boegershausen | 229/4.5 |
| 3,279,675 | 10/1966 | Elam et al. | 229/4.5 |
| 3,338,020 | 8/1967 | McGee | 493/101 |
| 3,370,773 | 2/1968 | Mayo | 229/3.1 |
| 3,406,891 | 10/1968 | Buchner et al. | 229/5.5 |
| 3,445,049 | 5/1969 | Carpenter, Jr. | 220/461 |
| 3,715,853 | 2/1973 | Bemiss | 493/101 |
| 4,191,305 | 3/1980 | Davis | 229/4.5 |
| 4,286,745 | 9/1981 | Fukuoka | 229/4.5 |
| 4,546,911 | 10/1985 | Clauss | 229/5.6 |

FOREIGN PATENT DOCUMENTS

| | | | |
|---|---|---|---|
| 881899 | 7/1953 | Fed. Rep. of Germany | 229/4.5 |
| 2911939 | 10/1980 | Fed. Rep. of Germany | 229/4.5 |
| 3208682 | 9/1983 | Fed. Rep. of Germany | 229/4.5 |
| 316693 | 10/1969 | Sweden | 220/461 |
| 894827 | 4/1962 | United Kingdom | 229/3.1 |

*Primary Examiner*—William Price
*Assistant Examiner*—Gary E. Elkins
*Attorney, Agent, or Firm*—Burns, Doane, Swecker & Mathis

[57] ABSTRACT

In the course of the preparation of a double-walled paper container, two jacket blanks are wound in circumferentially offset relationship with the end edges of each blank disposed in mutually facing relationship following the winding. The joints formed by the end edges are preferably covered by a foil in the form of a tube which is applied after the blanks have been wound.

2 Claims, 13 Drawing Figures

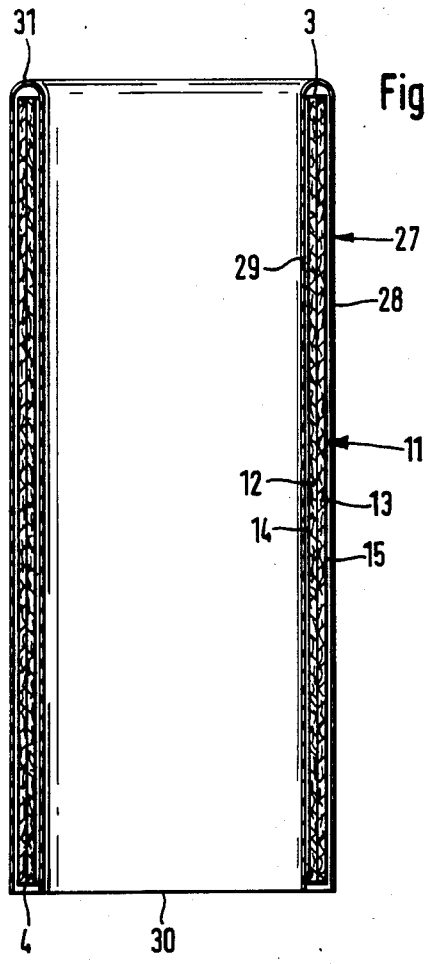
Fig. 5
Fig. 6
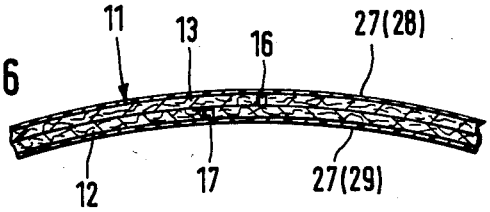

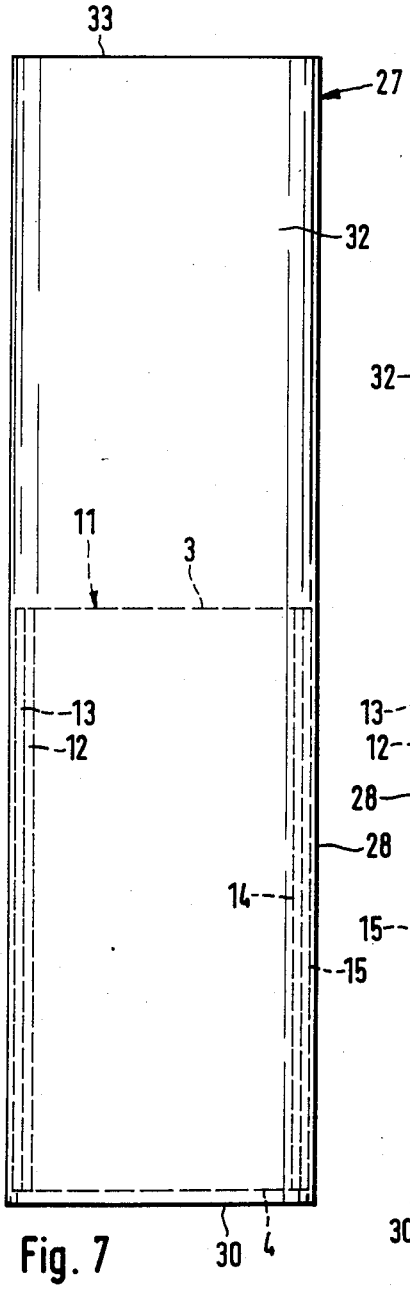
Fig. 7
Fig. 8
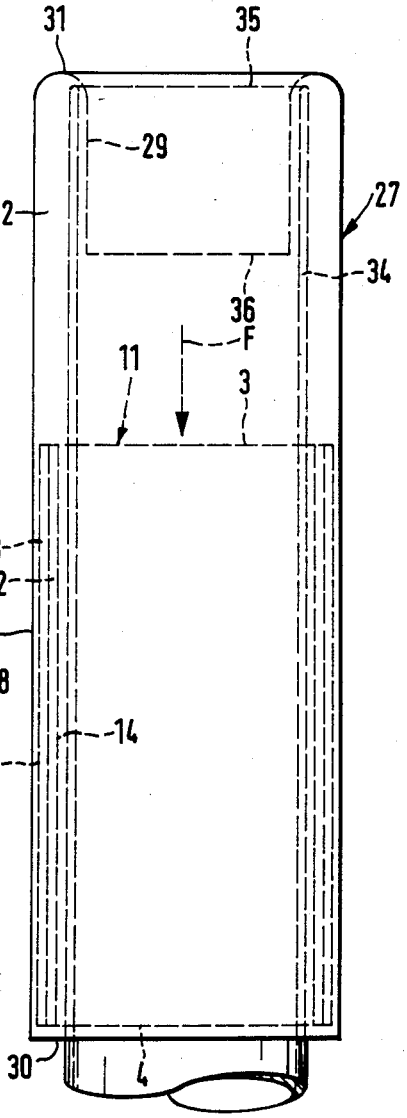

PAPER CONTAINER WITH A JACKET WOUND WITH A DOUBLE WALL AND PROCESS FOR ITS PREPARATION

BACKGROUND AND OBJECTS OF THE INVENTION

The invention concerns a paper container with a jacket wound with a double wall, the jacket blanks whereof are essentially of the same length in the direction of winding, but arranged offset with respect to each other and bonded together by gluing or sealing.

Paper containers of this type are known from German DE-OS No. 3,208,682. To seal the open cut edges of the overlapping jacket ends, the two jacket blanks are offset with respect to each other in a manner such that one blank is always slightly overlapping the other. The overlapping edge is folded so that the open cut edge of the inner container jacket is resting with a border edge on the corresponding cut edge of the outer container jacket, so that following the sealing of the container jacket there are no open cut edges. The disadvantage of such jackets consists of the fact that in the area of the overlap there is a double wall thickness. This affects not only the appearance of the container, but also renders the tight-sealing or crimping of the bottom into the container jacket after winding difficult.

It is known from German DE-P No. 881 899 to wind single wall supporting cardboard jackets for nonmetallic containers such that the end edges thereof are in mutually facing relationship. There, however, the supporting jacket is covered by several layers of paper, so that the known container cannot be equated with a container of the type with which the present invention relates.

It is an object of the invention to design a paper container with a double wall, wound jacket of the above-mentioned type so that there are no thickened areas in the jacket walls.

SUMMARY OF THE INVENTION

This object is attained in that both blanks for the jacket are wound in an abutting relationship whereby the ends of each blank contact the other blank.

By this measure the overlap of the wound double wall may be omitted, so that the container jacket has a uniform wall thickness over its entire circumference. As the result of the fact that the blanks are arranged offset with respect to each other in the circumferential direction, the inner and outer joints are not located in superposed relationship, so that adequate stability is also assured, as one edge of the outer jacket wall overlaps an edge of the inner jacket wall.

It is preferable to offset the blanks and their joints with respect to each other by a slight amount only. This facilitates the sealing process after winding, as the surfaces to be sealed are adjacent to each other. Furthermore, in the case of an optional covering of the open cut edges by cover strips, the latter may be kept adequately narrow.

In a development of the invention it is provided that the joint of the outer wall of the jacket is cut to more accurate tolerances than the joint of the inner wall. This reduces the manufacturing effort, as only the joint visible from the outside is required to satisfy stricter conditions.

It is convenient to protect the surfaces of the jacket walls at least on the inside. The wound container is thereby made suitable for substances capable of penetrating into paper material.

In an advantageous embodiment of the invention, it is provided to cover at least the inner joint by foil or the like. It is further appropriate to cover the entire internal side of the inner joint by foil or the like. This makes it possible under certain conditions to provide the inner wall with a liquid-tight coating. It is then sufficient to coat the areas to be sealed only.

In a further development of the invention, the foil is provided in the form of a tube to be applied following the winding of the jacket to the inner side of the inner jacket wall. This yields the advantage that there is no seam in the foil lining the inside of the container jacket. The lining of a paper sleeve with a foil is known from German DE-OS No. 29 11 939, but in the present case the foil is to be formed in advance to fit the jacket. The known paper sleeve is first expanded so that the sleeve-like foil lining may be inserted. Subsequently, the paper sleeve shrinks onto the liner, which therefore must be of a minimum thickness.

In a further development of the invention it is provided that the length of the foil tube corresponds to approximately twice the width and height, respectively, of the jacket and that the foil tube covers both the inside of the inner jacket wall and the outside of the outer jacket wall. The container jacket is thereby sealed seamlessly both on its outside and inside and the upper cut edge is also covered. The wall thickness of the foil tube is negligibly thin compared with the wall thickness of the paper jacket so that the foil tube is easily deformed. It is advantageous if the foil tube is self-adhering to the associated jacket wall. For this purpose, the self-adhesion resulting from the reduced pressure necessarily generated during the application of the foil tube, is already sufficient. Consequently, any adhesive bonding or sealing may be omitted in relation to the foil tube.

The container jacket according to the invention may be prepared in different ways. In one of the processes, the blanks for the inner jacket wall and the outer jacket wall may be placed flat over each other and adhesively bonded or sealed together and the double-walled blanks prepared in this manner wound subsequently into the jacket of the paper contained. This yields the advantage that a single winding process per container is sufficient.

In an advantageous process for the preparation of the jacket for the paper container, two webs of paper placed upon each other in essentially equal widths are offset in a direction transverse to their longitudinal direction to form lateral edge strips. The webs are conveyed to a processing station, whereupon blanks are cut from the webs of paper in the direction of the width and optionally adhesively bonded or sealed together, whereupon the double-walled container is wound. In this process it is no longer necessary to produce initially the individual blanks and then place them upon each other. Rather, the individual walls of the jacket may be unwound from a long web.

In a further production process the blank for the inner jacket wall is wound and the blank for the outer wall subsequently wound around the already formed inner jacket. The blanks forming the container jacket are thus prepared individually, which is technically simpler, as the wall to be wound in each instance is less rigid.

In a preferred production process the wound, double-walled jacket is introduced into a foil tube or the foil tube passed over the jacket, so that the foil tube is filled by the jacket only approximately one-half of its length, whereupon the other half of the foil tube is folded over the inside of the jacket. Alternatively, the foil tube may be inserted into the double-walled jacket or the jacket passed over the foil tube, in a manner such that the foil tube is surrounded by the jacket only approximately one-half its length, whereupon subsequently, the other half of the foil tube is folded around the outside of the jacket. In both cases the lining of both the inner and outer jacket walls may be effected by a single step production process

BRIEF DESCRIPTION OF THE DRAWINGS

The object and advantages of the invention will become apparent from the following description of preferred embodiments thereof in connection with the accompanying drawings in which like numerals designate like elements, and in which:

FIG. 5 is a schematic longitudinal sectional view taken through a double walled, wound container jacket, covered inside and outside by a foil tube;

FIG. 6 depicts a part of a cross-sectional through the container jacket of FIG. 5 in the area of the joints;

FIG. 7 depicts a container jacket introduced in a foil tube;

FIG. 8 depicts the container jacket of FIG. 7, with the foil tube being folded over the upper cut edges to cover the inner jacket wall;

DETAILED DESCRIPTION OF PREFERRED EMBODIMENTS OF THE INVENTION

Figure 1:
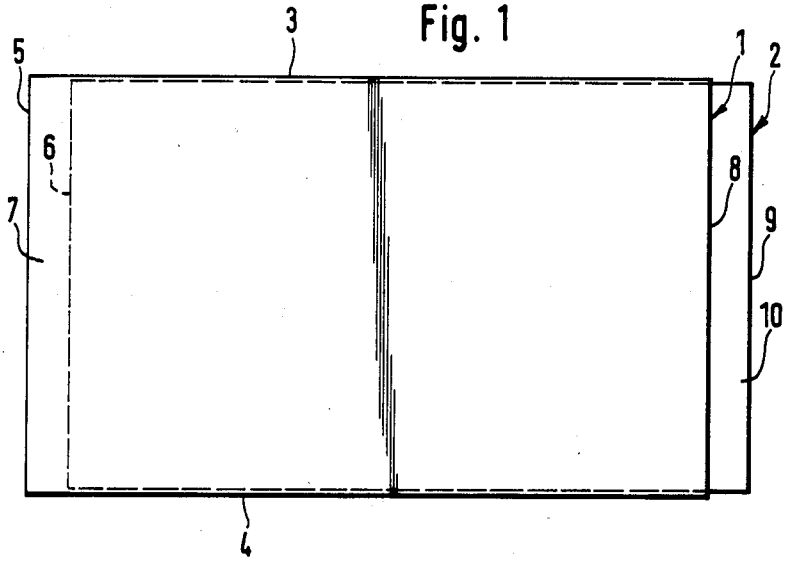
FIG. 1 shows a top view of two jacket blanks placed upon each other prior to the winding of a new jacket for a paper container.

FIG. 1 shows the blanks 1 and 2 for a double walled container jacket to be wound. The blanks 1 and 2 are placed flat over each other in a manner such that the upper edges 3 and the lower edges 4 of both blanks 1 and 2 are coincident. However, the blanks 1 and 2 are offset with respect to each other in the direction of subsequent winding so that they extend past each other by an edge strip 7 and 10, respectively, of equal width. The edges 5 and 8 of the blank 1 and the edges 6 and 9 of the blank 2 form open cut edges after the winding along a generator of the jacket. The blanks 1 and 2 located over each other may already be adhesively bonded or sealed in this state.

Figure 2:
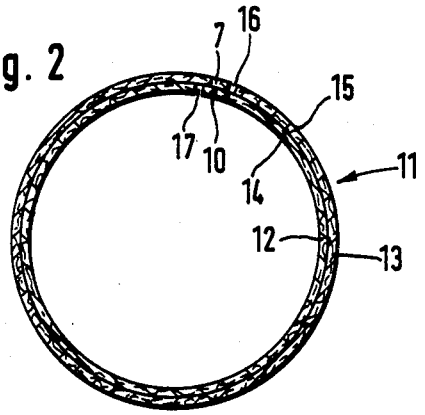
FIG. 2 is a schematic sectional view through a double-walled jacket wound according to the present invention.

FIG. 2 shows the blanks 1 and 2 following the winding of the double walled jacket 11. The blank 1 then forms the outer jacket wall 13 and the blank 2 the inner wall jacket 12. The inside of the jacket 11 is designated by 14 and the outside by 15. It is seen in FIG. 2 that following the winding of the jacket 11, the joints 16 and 17 are circumferentially offset only slightly with respect to each other, i.e., by the amount of the edge strips 7 and 10. This simplifies sealing after the winding of the jacket 11. It is seen further that the wound double-walled jacket 11 has no thickened areas, because the end edges of each blank are disposed in mutually facing relationship, i.e., the edges 6 and 9 face one another and the edges 5, 8 face one another. In spite of this, adquate stability is assured, because the outer jacket wall 13 overlaps with its edge 7 the inner wall 12 in the area of its edge 10. The end edges of the outer jacket 13 are preferably spaced closer together than are the end edges of the inner jacket 12 to simplify manufacture since only the joint visible from the outside is required to satisfy strict appearance criteria.

Figure 3:
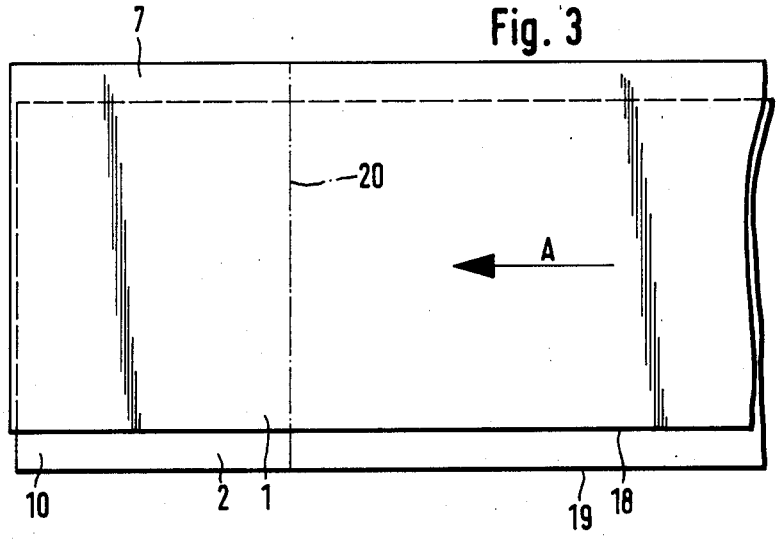
FIG. 3 is a schematic view of the introduction of a foil web from which the individual blanks are taken.

The preliminary work of the winding process may be carried out according to FIG. 3 so that two webs of paper 18 and 19 are guided in the direction of the arrow A to a processing station. The webs of paper 18 and 19 are offset with respect to each other transverse to the direction A so that the edge strips 7 and 10 described in FIG. 1 are formed by a lateral overhang. In the processing station (not shown), the blanks 1 and 2, already bonded together, are cut along a cutting edge 20 from the webs 18 and 19. In this manner, the blanks 1 and 2, described in relation to FIG. 1 and offset with respect to each other, are produced.

Figure 4:
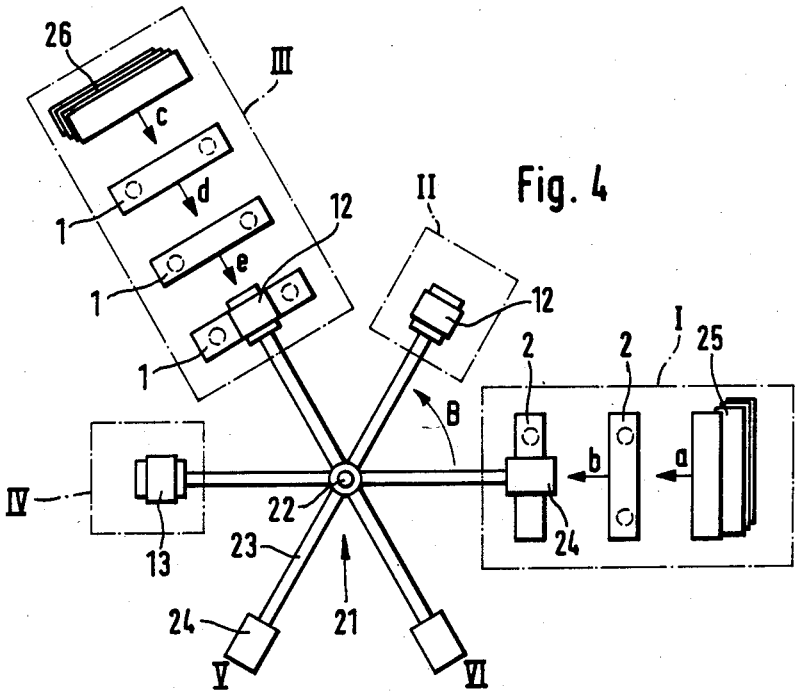
FIG. 4 depicts a winding star for one process to produce a jacket for a paper container according to the present invention.

FIG. 4 shows a conventional winding star 21 with several work stations I to VI to carry out production according to the invention. The winding star 21 may be driven in the direction of the arrow B around a stationary axle 22 and has a total of six arms 23 arranged in the form of a star, each of them carrying a winding mandrel 24, which in the present example are cylindrical.

The processing station I shown schematically by a dash-and-dot rectangle, serves to prepare and wind the inner jacket wall 2. From a stack 25 located at the processing station I, a blank 2 is transported in each instance individually (direction of arrow a) and in keeping with the direction of the arrow b to the winding mandrel 24 around which it is wound into a jacket, which subsequently will form the inner jacket wall 12 in the double-walled jacket 11. The winding mandrel 24 holds the wound jacket of the inner wall 12 by air suction, as the blank 2 does not overlap following the winding and thus cannot be sealed at this time. Subsequently, the winding star 21 is phased into the cycle so that winding mandrel 24 equipped with the inner jacket 12 is conveyed to the processing station II. At the processing station I, at this point in time, the next blank 2 may already be taken in the above-described manner from the stack 25 and passed to the next winding mandrel 24. The processing station II may already serve to prepare for the subsequent sealing process. For this purpose, the inner jacket 12 is exposed in the area of its joints to hot air or the like. The inner jacket 12 then arrives, by means of another incremental movement of the winding star 21, at the processing station III. At the processing station III, a stack 26 with blanks 1 for the outer wall 13 of the jacket is located. A blank 1 is singled out in each instance in the direction of arrow c and provided with a coating of glue. After further conveyance in the direction of arrow d the blank 1 is also heated with hot air or the like. Subsequently, the blank 1 is guided in the direction of arrow e to the winding mandrel 24, on which the inner jacket 12 is already being held in the unsealed state. The blank 1 is now wound into the outer jacket 13 around the inner jacket 12 in the manner shown in FIG. 2, whereby simultaneously, the areas of the joints 16 and 17 are sealed. The double jacket 11 then rotates with the winding star 21 to the processing station IV, where further processing steps are carried out, for example, the insertion of a container bottom not yet shown. For the winding star 21 further processing station V and VI (not described in detail) may be provided, at which for example, a mouth roll may be formed or a synthetic plastic ring attached.

FIG. 5 shows a longitudinal section through a ready wound double-walled jacket 11, comprising an inner jacket 12 and an outer jacket wall 13. To cover the inner side 14 and the outer side 15 of the jacket 11 and the upper cut edges 3, a foil tube 27 is provided, which is placed around the jacket 11 in a manner to be described later, as shown in FIG. 5. The outer wall 28 of the foil tube 27 covers the outside 15 of the jacket 11 and the inner side 29 of the foil tube the inside of the jacket 11. Prior to the lining of the jacket 11 with the very thin foil tube 27, the sides 28 and 29 are aligned with each other (FIG. 7). FIG. 6 shows that the joints 16 and 17 of the double-walled jacket 11 are also covered by the foil tube 27.

FIG. 7 illustrates schematically how the foil tube 27 is placed over the double-walled jacket 11. The lower edge 30 of the foil tube 27 is placed so that it coincides approximately with the lower edge 4 of the jacket 11. The upper edge 3 of the double-walled jacket 11 is then located so that the jacket 11 fills the foil tube 27 to approximately one-half of its length only, while the foil tube 27 is extending with one-half of its length past the jacket 11. The double-walled container jacket is now already covered on the outside 15 by the exterior portion 28 of the foil tube 27. The overhanging area 32 of the foil tube 27 is now folded inside, as will be explained with reference to FIG. 8. In order to facilitate the contacting of the inside 14 of the double-walled jacket 11 by the interior portion 29 of the foil tube 27, a guide sleeve 34 is provided as an auxiliary tool and is inserted into the jacket 11. The guide sleeve 34 is being withdrawn in the direction of the arrow F at the rate at which the area 32 of the foil tube 27 is being folded over the upper cut edge 3.

FIG. 8 shows an intermediate stage; the upper edge 33 of the foil tube 27 of FIG. 7 has already attained the position 36 in this intermediate stage. As soon as the guide sleeve 34 is again withdrawn entirely from the double-walled jacket 11 in the direction of the arrow F, the foil tube 27 surrounds the double-walled jacket 11 in the manner shown in FIG. 5, already described.

Figure 9A:
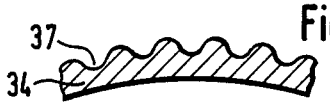
FIG. 9*a* depicts a detail of FIG. 9 in cross-section.
Figure 9:
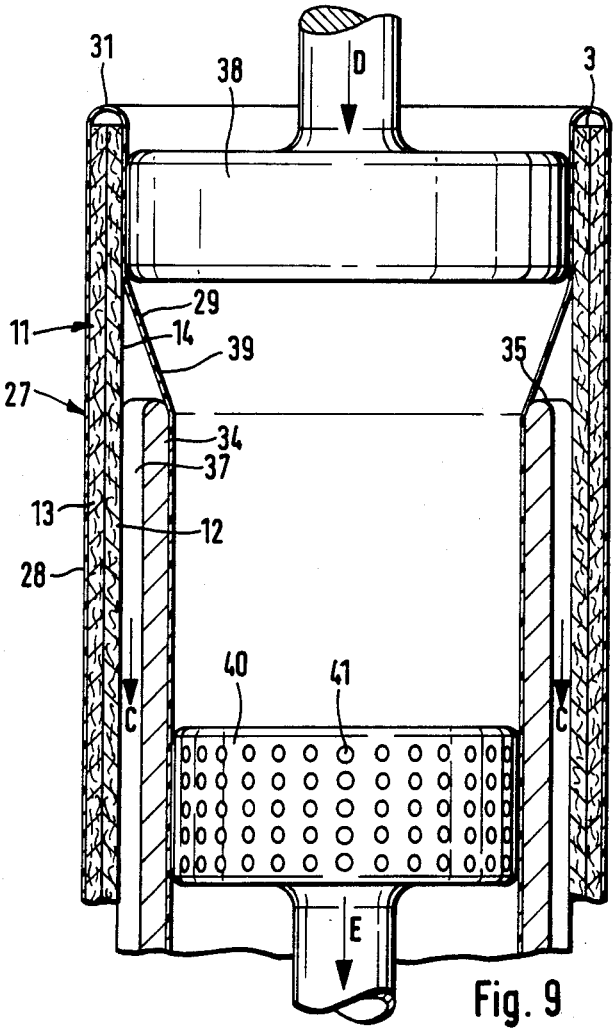
FIG. 9 depicts a device to fold the foil tube around the jacket.

In the course of folding of the area 32 of the foil tube 27 as described in FIG. 8, a certain difficulty is encountered; it consists of the fact that in the area of the inside 14 of the double-walled jacket 11 air must escape, as it is displaced by the covering. Furthermore, it must be assured that the interior portion 29 of the foil tube 27 is contacting the inside 14 of the jacket 11 tightly. For this purpose, a device shown in FIG. 9 is provided. The guide sleeve 34 is shown at a radial distance from the inside 14 of the double-walled jacket 11. It is seen in the partial cross-sectional view of FIG. 9*a* how this radial distance 37 of the guide sleeve 34 is obtained by a corresponding corrugation of the external circumference of the guide sleeve 34. The displaced air may escape through the annular gap 37 formed in the direction of the arrow C, when the guide sleeve 34 is withdrawn in the direction of the arrow F (FIG. 8). A cylinder-like plunger 40 is used to fold the foil tube 27 over the upper cut edge 3, over which the foil tube 27 is draped with a fold 31. The plunger 40 is hollow on the inside and is connected with a source of vacuum. It comprises on its circumferential surface a plurality of suction orifices 41 holding the inside 29 of the foil tube 27 so that by moving the plunger 40 in the direction of the arrow E the foil tube 27 may be folded over. The plunger 40 is guided so that it has a certain advance with respect to the upper edge 35 of the guide sleeve 34.

Above the guide sleeve 34, a second plunger 38 follows the guide sleeve 34 at a certain distance. The plunger 38 moves in the direction of the arrow D and serves to contact the inside 29 of the foil tube 27 tightly with the inside of the double-walled jacket 11. In the intermediate position shown in FIG. 9, the foil tube 27 is unguided within an area 39. The air escaping from this area in the direction of the arrow C assures that in the finished state the inside 29 of the foil tube 27 is in tight contact with the inside 14 of the double-walled jacket 11 and adheres to it automatically. The adhesion is tight enough even without the use of any adhesive so that it is scarcely possible to remove the foil tube manually from the jacket 11.

Figure 10:
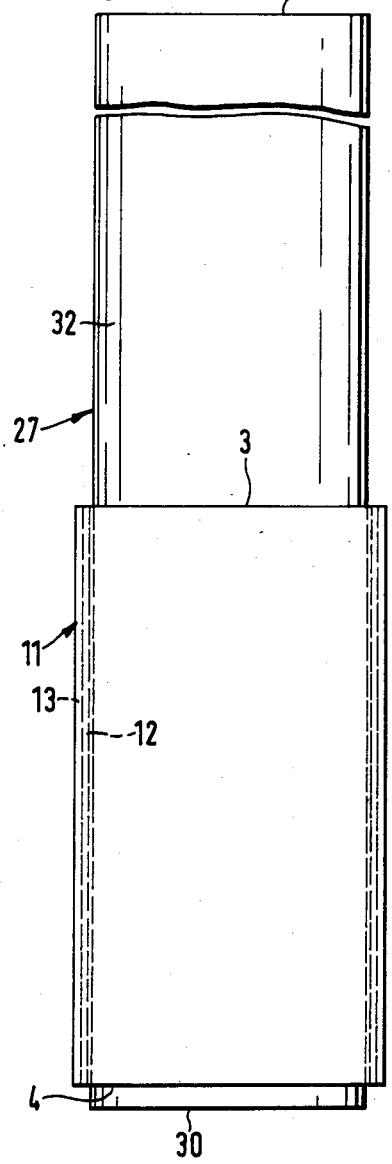
FIG. 10 depicts a wound jacket into which a foil tube had been introduced.
Figure 11:
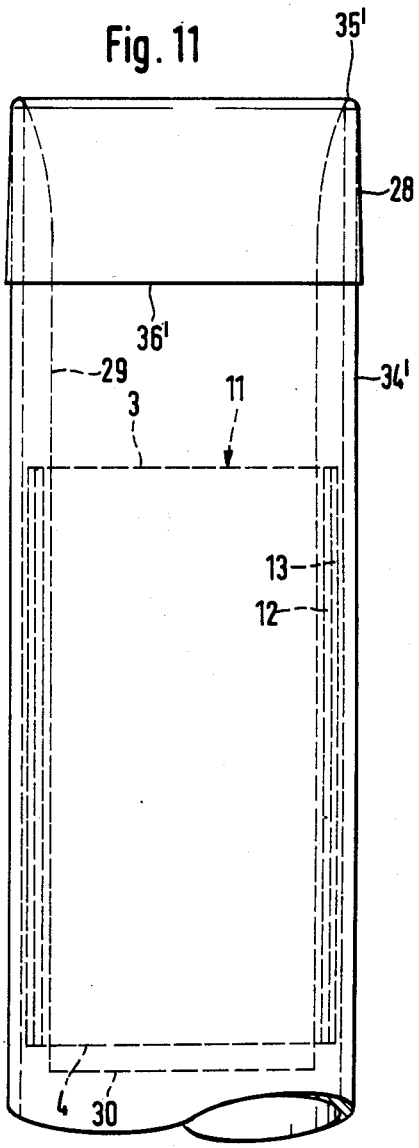
FIG. 11 depicts the jacket of FIG. 10, with the foil tube being folded to the outside over the upper cut edges.

FIGS. 10 and 11 show an alternative in relation to FIGS. 7 and 8. In the process according to FIGS. 10 and 11, the foil tube 27 is introduced initially inside the double-walled jacket 11 so that it protrudes approximately with one-half of its length in the area 32 in the upward direction. Subsequently, the upper edge 33 of the foil tube 27 is folded down on the outside (shown in FIG. 11). The upper edge 33 of the foil tube 27 occupies the position 36' in the intermediate position as shown in FIG. 11. In the process, the foil tube 27 is folded over the upper edge 35' of a guide sleeve surrounding in FIG. 11 the double-walled jacket 11 from the outside and designated in this example of embodiment by 34'.

Figure 12:
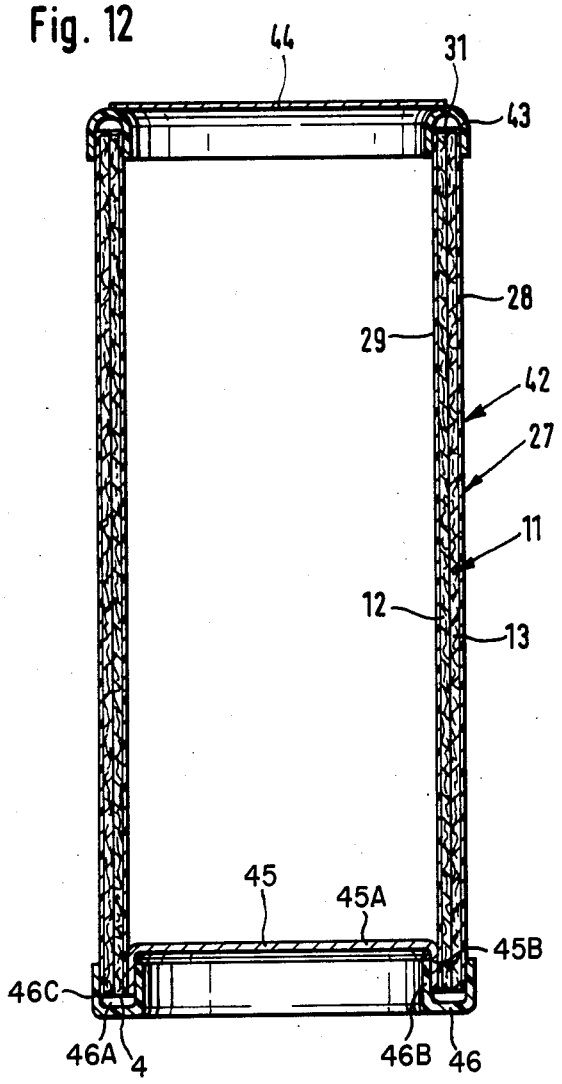
FIG. 12 depicts the finished container.

FIG. 12 shows the finished container 42, consisting of a double-walled jacket 11, a container bottom 45 and a top lid 44. The jacket 11 is surrounded by the sides 28 and 29 of the foil tube 27, which also covers the upper cut edge of the jacket 11 with its fold 31. The lower cut edges 4 of the jacket 11 and the container bottom 45 are covered by a synthetic plastic ring 46. The bottom includes a radial portion 45A which is offset radially inwardly from the associated longitudinal edge of the container. The bottom 45 also includes a longitudinally outwardly extending skirt 45B disposed against the internal portion 29 of the foil tube 27. The ring 46 includes a channel 46A defines by radially spaced, parallel inner and outer walls 46B, 46C. The skirt 45B, the inner and outer jackets 12, 13 and the internal and external foil tube portions 29, 28 are disposed within the channel 46A, with the outer wall 46C engaging the external tube portion 28, and the inner wall 46B engaging the skirt. A further plastic ring 43 is set onto the upper cut edges 43; it carries the lid 44. The plastic ring 43 and lid 44 may be fastened to the double-walled jacket 11 by sealing.

The finished container 12 has a wall with a uniform thickness over its entire cirucmference, with all of the cut edges covered both inside and outside, so that the container 42 is suitable also for liquids which would otherwise be capable of penetrating into the paper.

Although the present invention has been described in connection with preferred embodiments thereof, it will be appreciated by those skilled in the art that modifications, substitutions, deletions, and additions may be made without departing from the spirit and scope of the invention as defined in the appended claims.

What is claimed is:

1. Paper container of double-walled construction comprising an outer circular cylindrically-wound jacket and an inner circular cylindrically-wound jacket positioned within said outer jacket and joined thereto such that said inner and outer jackets define a common longitudinal axis, each said jacket having first and second end edges, said jackets each being wound such that said end edges thereof are linear and extend longitudinally in mutually facing relationship, said jackets being circumferentially offset relative to one another such that said end edges of said outer jacket are circumferentially offset relative to said end edges of said inner jacket, and end edges of said outer jacket being positioned closer together than said end edges of said inner jacket, said container including first and second longitudinal edges, said inner jacket including an inner surface, said outer jacket including an outer surface, a foil tube including an internal portion covering the entirety of said inner surface, and an external portion covering the entirety of said outer surface, an interface between said internal portion and said inner surface being air-free such that said internal portion self-adheres tightly against said inner surface, said internal and external portions being integrally joined together adjacent said first longitudinal edge and terminating at said second longitudinal edge which defines a bottom edge of said container.

2. Paper container according to claim 1 including a container bottom disposed at said bottom edge, said container bottom including a generallly radial portion offset longitudinally inwardly from said second longitudinal edge and a longitudinally outwardly extending skirt disposed against said internal portion of said foil tube, a ring including a channel defined by radially spaced, parallel inner and outer walls mounted at said second longitudinal edge, said inner and outer walls being disposed parallel to said inner and outer jackets such that said skirt, said inner and outer jackets and said internal and external tube portions are disposed within said channel with said outer wall engaging said external foil portion, and said inner wall engaging said skirt.

* * * * *